US006279636B1

(12) United States Patent
Miller

(10) Patent No.: US 6,279,636 B1
(45) Date of Patent: Aug. 28, 2001

(54) METHOD AND APPARATUS FOR MERGING AND ATTACHING DOCUMENTS TO ENVELOPES

(76) Inventor: Daniel E. Miller, 9348 Bradford Trafford Rd., Warrior, AL (US) 35180

( * ) Notice: Subject to any disclaimer, the term of this patent is extended or adjusted under 35 U.S.C. 154(b) by 0 days.

(21) Appl. No.: 09/277,159

(22) Filed: Mar. 26, 1999

(51) Int. Cl.[7] ..... B32B 31/00

(52) U.S. Cl. ..... 156/351; 156/352; 156/354; 156/355; 156/358; 156/362; 156/156; 156/566; 156/570; 271/34; 271/164; 271/220; 271/274

(58) Field of Search ..... 156/521, 570, 156/362, 566, 569, 580, 351, 352, 354, 355, 358; 271/220, 34, 164, 274

(56) References Cited

U.S. PATENT DOCUMENTS

| | | | | |
|---|---|---|---|---|
| 3,547,013 | * | 12/1970 | Gentry | 493/343 |
| 3,885,783 | * | 5/1975 | Anderson | 271/34 |
| 3,964,953 | * | 6/1976 | Mitchard et al. | 156/300 |
| 3,973,767 | * | 8/1976 | Kramer | 271/12 |
| 4,369,959 | * | 1/1983 | Kornbuckle | 271/3.03 |
| 4,586,975 | | 5/1986 | Derby | 156/191 |
| 4,786,789 | | 11/1988 | Gaucher | 235/432 |
| 4,929,296 | * | 5/1990 | Zorzolo | 156/357 |
| 5,033,729 | | 7/1991 | Struthers | 271/10.06 |
| 5,036,984 | | 8/1991 | Labarthe | 209/3.3 |
| 5,097,517 | | 3/1992 | Holt | 382/137 |
| 5,199,700 | * | 4/1993 | Fairey et al. | 271/209 |

* cited by examiner

*Primary Examiner*—Linda Gray
(74) *Attorney, Agent, or Firm*—Wm. Randall May

(57) ABSTRACT

A method and system for automatically merging and attaching documents, such as photocopies of remittance checks or the like, to envelopes from which the documents originated is disclosed. The system uses a series of bins and conveyors to automatically retrieve, synchronize, merge and reassociate each document to its respective envelope.

23 Claims, 3 Drawing Sheets

METHOD AND APPARATUS FOR MERGING AND ATTACHING DOCUMENTS TO ENVELOPES

BACKGROUND OF THE INVENTION

This invention relates generally to collation or document merging devices and methods and more specifically to a method and apparatus for attaching photocopies of checks or other documents to the envelopes or other transport medium from which the checks or other documents originated.

The present invention has particular application within the "lockbox industry". Wholesale and retail lockbox services are routinely used by businesses that receive large volumes of retail payments or corporate-to-corporate receiveables. The primary objective of a lockbox operation is to have the subscriber's customers remit payment checks to a local post office box in order to minimize transit time, processing expenses and handling costs. Lockbox providers thus serve as agents for receiving and depositing payments thereby maximizing the availability of funds while reducing mail costs, processing time and check clearing float times. Lockbox services are designed to process large volumes of payments received by mail and to provide subscribers of the service with daily remittance information for manual or automated reconciliation of the subscriber's customer accounts. The checks received are processed by the lockbox provider, usually a cash management bank, on a daily basis and the funds collected are deposited into the subscriber's deposit account with the bank. The collected funds are therefore usable by the receiving business much quicker than with the traditional process.

However, once the lockbox subscriber has been given credit for the funds in its demand deposit account, the subscriber must then pass along the credits to its respective customer accounts. Presently, a high percentage of lockbox subscribers do not receive electronic updates to their receivables and must rely on photocopies of the original remittance checks from which to post and reconcile their customer accounts.

In a typical lockbox operation, each remittance envelope received must first be opened and the remittance check contained therein must then be separated and removed from other correspondence which may be contained within the envelope. Any such correspondence must then be placed back into the remittance envelope for eventual forwarding to the lockbox subscriber. Once the remittance check is removed from its envelope, it must be photocopied or printed from scanned images. Within the lockbox industry, check photocopies are generated by either replicating scanned images of the checks on computer printers or, more typically, by reproducing the checks on conventional copiers. Copies of checks are usually reproduced three or more to a page and are separated, as by cutting or perforation, into single check-size copies. Each copy must then be reattached to the remittance envelope from which it originated. Upon completion of this process, the check photocopies, attached to their respective remittance envelopes, are forwarded to the lockbox subscriber for posting to its customer accounts.

Today, virtually every cash management bank provides, or is involved to some degree with, retail or wholesale lockbox collection services. The accelerated mail receipt and improved funds availability provided by these services are very attractive to many business owners. However, the process of reassociating and reattaching photocopies of checks to their respective remittance envelopes for return to the business subscriber is one of the most time consuming and labor intensive functions of the lockbox service. It would be expedient, therefore, to provide a method and apparatus which would effectively automate this process thereby virtually eliminating the manual labor associated with this phase of the lockbox service.

SUMMARY OF THE INVENTION

In view of the foregoing, it is a primary object of this invention to provide a method and apparatus for automatically merging and attaching photocopies of remittance documents to the envelopes or other transport medium from which such remittance documents originated.

According to an embodiment of the invention, an apparatus for merging and attaching photocopies to envelopes comprises a photocopy hopper, an envelope hopper, a cutter means, a conveyor system, a securing means, a stacking means, and a control means.

It is an object of the present invention to provide method and apparatus which effectively eliminates the manual labor associated with merging and reattaching remittance documents to the envelopes or other transport medium from which the documents originated.

Another object of the present invention is the provision method and apparatus which provides automation for a very labor intensive aspect of mail remittance processing thereby greatly reducing the cost of such processing.

An important advantage of the present invention is the provision of method and apparatus which greatly increases the efficiency of mail remittance processing for industries such as retail and wholesale "lockbox" collection services.

Another advantage of the present invention is the provision of method and apparatus which greatly reduces processing and handling times for mail remittance processing and provides subscribers of lockbox type collection services with faster access to remitted funds and posting information.

Another advantage of the present invention is that the method and apparatus provided herein greatly reduces labor and overall costs associated with mail remittance processing.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
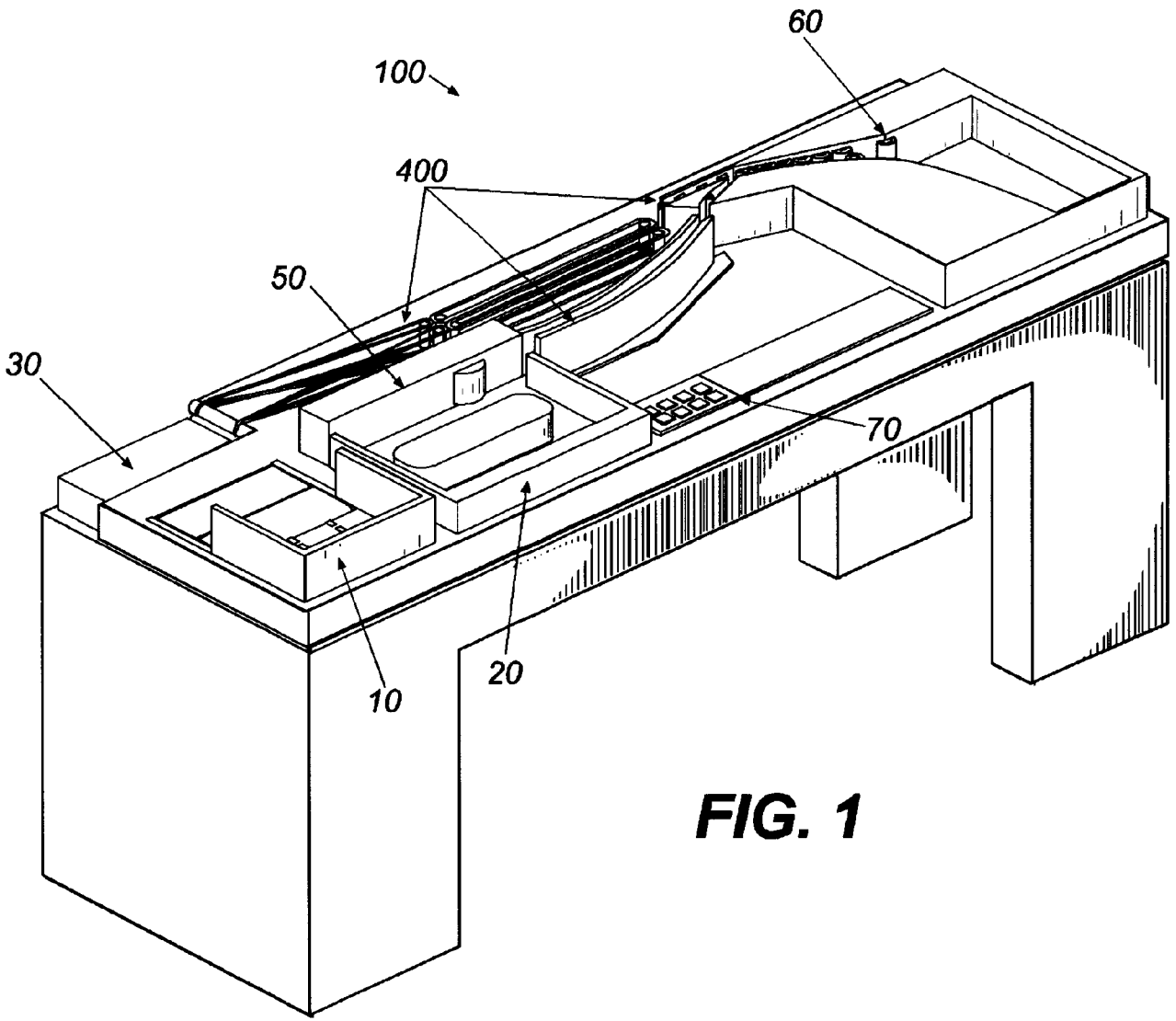
FIG. 1 is a perspective elevational view of an embodiment of the invention.

In accordance with an embodiment of the invention, FIG. 1 shows a document merging system 100 for automatically merging and attaching photocopies of remittance or other documents to the envelopes, or other transport medium, from which the documents originated. The system 100 comprises a photocopy hopper 10, an envelope hopper 20, a cutter means 30, a conveyor system 400, a securing means 50, a stacking means 60, and a control means 70.

Figure 2:
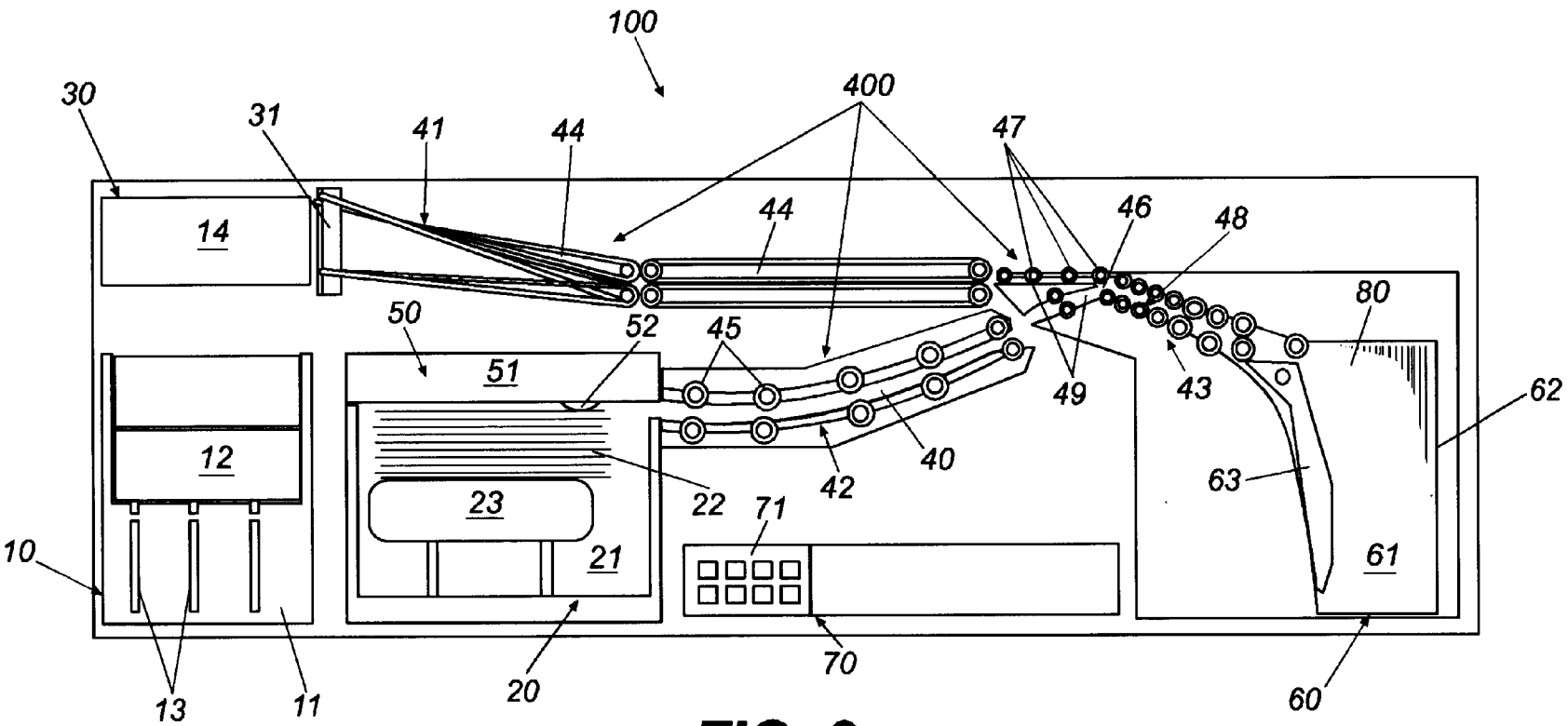
FIG. 2 is a plan view of the embodiment of FIG. 1.

The conveyor system 400 of the present invention, as best seen in FIG. 2, is designed to facilitate and coordinate the association and joining of two documents automatically and comprises a photocopy conveyor means 41, an envelope conveyor means 42 and a stacker conveyor means 43.

The photocopy hopper 10 comprises a tray or bin 11 into which is loaded photocopy sheets 12 containing images of documents such as remittance checks. The photocopy sheets 12 are placed face down in the photocopy hopper bin 11 in a predetermined order for cutting, if necessary, and for later association with their respective remittance envelopes, or other transport medium. The photocopy hopper 10 further comprises a plurality of feeder belts 13 situated along the bottom of the photocopy hopper bin 11 for advancing and transporting the photocopy sheets 12 to the cutter means 30 and/or the photocopy conveyor means 41 of said conveyor system 400, as necessary.

The cutter means 30 comprises a typical paper cutting device which is designed to automatically cut the images imprinted on the advancing photocopy sheets 12 into predetermined "check-size" image strips 14 for any photocopy sheets 12 having more than one document image per sheet 12. The cutter means 30 further comprises advancement rollers 31 for advancing the image strips 14 to the photocopy conveyor means 41 for further processing.

The envelope hopper 20 comprises a tray or bin 21 for receiving remittance envelopes 22 from which the photocopied documents contained in the photocopy hopper 10 originated. The remittance envelopes 22 are vertically stacked into the envelope hopper 20 in an order corresponding to the order of the images contained on the photocopy sheets 12 within the photocopy hopper 10. The envelope hopper 20 further comprises an urging means 23 for advancing and transporting the remittance envelopes 22 toward the securing means 50 for further processing.

The securing means 50, in this embodiment, comprises an applicator device 51 for applying an adhesive along the upper portion of the advancing side of each remittance envelope 22. In an alternate embodiment, the securing means 50 may comprise an attachment device such as an automatic stapler which would be stationed at or near the point the image strips 14 merge with their respective remittance envelopes 22. The securing means 50 further comprises one or more advancement rollers 52 for lateral movement of each envelope 22 toward the envelope conveyor means 42 of said conveyor system 400 as the applicator device 51 is applying adhesive to said envelopes 22, as previously indicated.

The photocopy conveyor means 41 of the conveyor system 400 comprises a plurality of conveyor belts 44 which are designed to receive and rotate the "check-size" image strips 14 advanced from the cutter means 30. The belts 44 rotate the strips 14 from their original horizontal position to an upright or vertical position. The image strips 14 are rotated and advanced, in a controlled manner, along said conveyor belts 44 toward a conveyor pinch point 46, positioned along the stacker conveyor means 43, for eventual merging with their respective remittance envelopes 22.

The envelope conveyor means 42 comprises a plurality of advancement rollers 45 situated along an envelope advancement channel or track 40 for advancing the remittance envelopes 22, in a vertical position, from the securing means 50 toward said pinch point 46 of said stacker conveyor means 43. The envelopes 22 are advanced, in a controlled manner, along said envelope advancement track 40 of said envelope conveyor means 42 simultaneously with the advancement of their respective document image strips 14, along said photocopy conveyor means 41, for eventual merger with, and attachment to, said document image strips 14. The advancement track 40 and rollers 45 of said envelope conveyor means 42 are adjustable to allow for varying thicknesses of the envelopes 22. Said rollers 45 are positioned in such a manner as to allow the envelopes 22 to pass along the conveyor means 41 without touching, or otherwise interfering with, the adhesive which has just been applied to the envelopes 22 by the applicator device 51 of the securing means 50.

The stacker conveyor means 43 comprises a plurality of merge rollers 47 situated along a document merger track 48. Said merger track 48 being divided into a pair of channels 49 which converge at the pinch point 46 of said stacker conveyor means 43. Said channels 49 are designed to receive the envelopes 22 and the image strips 14 from their respective conveyor means 41 & 42 and to advance the two documents 22 & 14 simultaneously into the pinch point 46 gate of the stacker conveyor means 43 for merger. The advancement of the two documents 22 & 14 along their respective conveyor means 41 & 42 is timed and controlled so that the two documents 22 & 14, hereinafter referred to as the "merged documents" 80, are caused to unite at their leading edge. The merger track 48 and merge rollers 47 of the stacker conveyor means 43 are adjustable to allow for varying thicknesses of said merged documents 80. During merger, the merge rollers 47 at the pinch point 46 of said stacker conveyor 43 cause the merged documents 80 to be firmly pressed together thereby adhering the merged documents 80 to each other. As previously stated, in an alternate embodiment, an attachment means, such as an automatic stapling device, situated at or near the pinch point 46 of said stacker conveyor 43 could be used to secure the merged documents 80 to each other.

The stacking means 60 of the present invention comprises a completion hopper 61 for receiving and holding the merged documents 80. Said merged documents 80 are received by the completion hopper 61 from the stacker conveyer means 43 upon completion of the merging process. The completion hopper 61 of the stacking means 60 comprises a tray or bin 62 for receiving and holding the merged documents 80. The completion hopper 61 further comprises a gate means 63 for automatically sensing and allowing the entry of the merged documents 80 into said completion hopper 61. Once the merged documents 80 have been received into said completion hopper 61, the gate means 63 applies tension to the merged documents 80 to ensure the merged documents 80 are properly stacked within the completion hopper bin 62 and do not fall forward.

Figure 4:
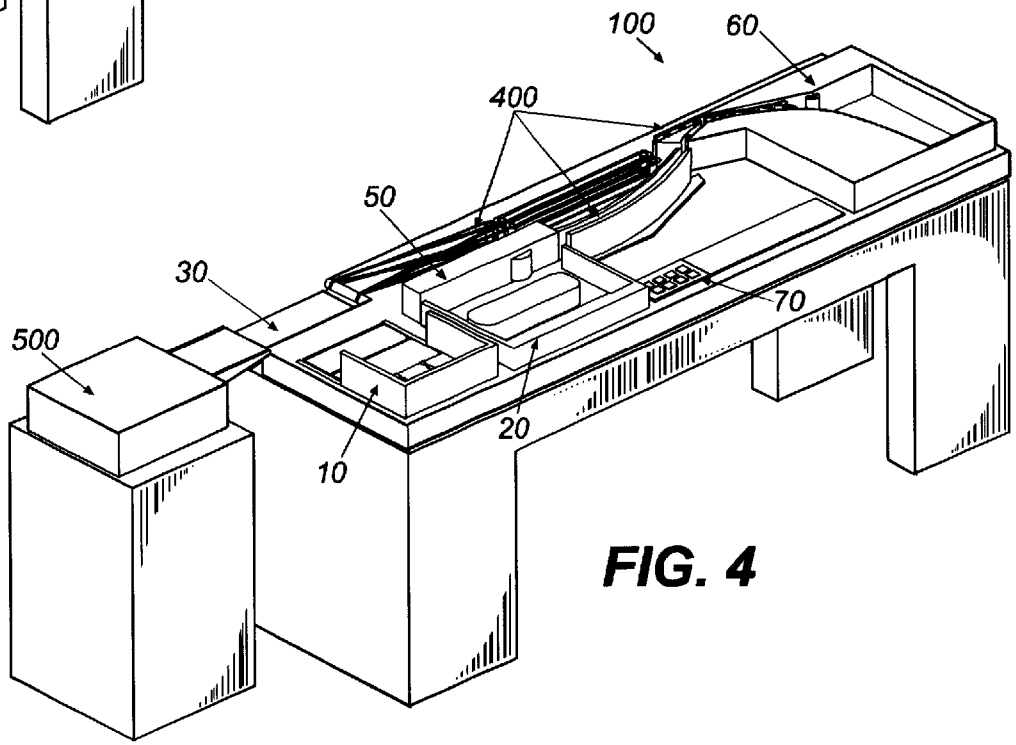
FIG. 4 is a perspective elevational view of the embodiment of FIG. 1 showing the attachment of a printer device.
Figure 3:
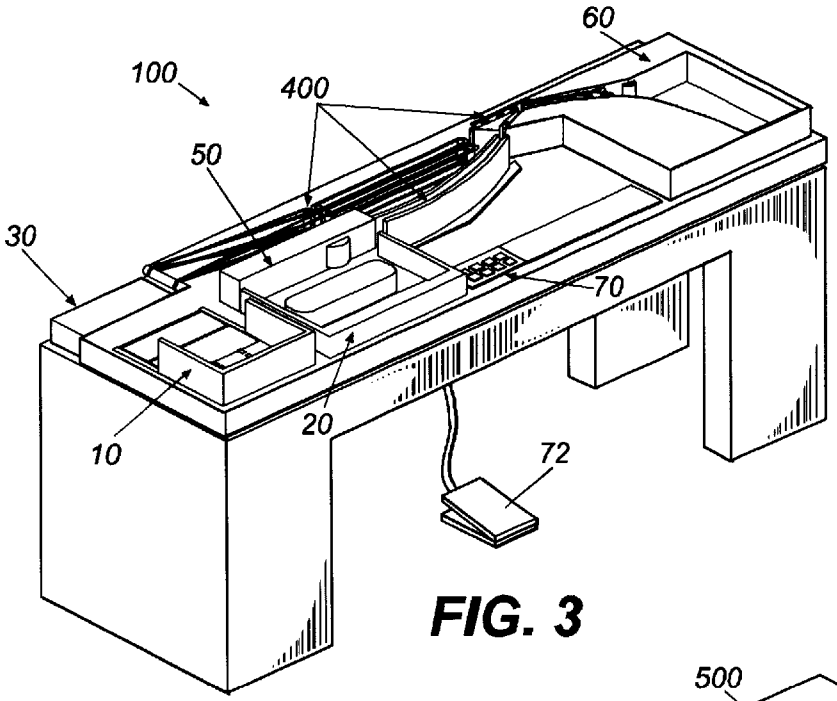
FIG. 3 is a perspective elevational view of the embodiment of FIG. 1 showing the control pedal of the invention.

The operation of the merging system 100 is controlled by the control means 70. The control means 70 of the present embodiment comprises an advancement control panel 71 and a brake/advance pedal 72 (see FIG. 3). The advancement control panel 71 controls the advancement speed of the image strips 14 and the envelopes 22 from their respective hoppers 10 & 20 through the conveyor means 40 to the stacking means 60. The brake/advance pedal 72 operates as a stop/start switch to allow the operator to stop or start the system 100 as necessary for repairs or to verify and ensure proper document merging and quality control. The brake/advance petal 72 may also be configured to operate as an advancement and speed control device. In an alternate embodiment, the control means 70 may comprise a computer aided control panel for controlling all aspects of the system 100. A number of optional features may be added to the system 100 to improve its function and operation including photo-sensors for sensing the presence of documents at various points on the system 100, number encoders for coding the documents, and mechanical or electrical counting devices for recording the number of items being processed. Image recognition technology may also be utilized with the system 100 to ensure correct matching of documents. As shown in FIG. 4, a printing machine 500 may also be linked to the system 100 for producing the image strips 14 necessary to complete the merging process.

In operation, an operator loads a batch of remittance envelopes 22 into the envelope hopper 20 of the merging system 100. Photocopy sheets 12 of checks or other remittance documents are then loaded face down into the photocopy hopper 10 in a predetermined order corresponding to the order of the remittance envelopes 22 which have been loaded into the envelope hopper 20. Once the remittance envelopes 22 and photocopy sheets 12 are loaded into their respective hoppers 20 & 10, the operator depresses the brake/advance pedal 72 to activate the system 100 merging cycle. As the photocopy sheets 12 enter the cutter means 30, the sheets 12 are cut (if necessary) into "check-size" document image strips 14 and each strip 14 is then caused to advance through the photocopy conveyor means 41 toward the pinch point 46 of the stacker conveyor means 43. Simultaneously with the advancement of the image strips 14, the remittance envelopes 22 are caused to advance to the securing means 50 for application of adhesive. Upon application of adhesive by the applicator means 51, each envelope 22 is caused to advance through the envelope conveyor means 42 toward the pinch point 46 of the stacker conveyor means 43 for merger with the advancing and corresponding image strip 14. The operator may use the advancement control panel 71 to adjust the speed of the documents being advanced through the system 100 to ensure proper merging and document matching. The operator may also at any time stop the cycle by depressing the brake/advance pedal 72. The advancement of the image strips 14 and the remittance envelopes 22 through the system 100 is timed and synchronized so that the leading edge of each document arrives at the pinch point 46 of the stacker conveyor means 43 at precisely the same moment. Upon merger, the "merged documents" 80 are caused to advance along the stacker conveyor means 43 to the completion hopper bin 62 of the stacking means 60 where the merged documents 80 are then removed by the operator and forwarded to the appropriate subscriber for review and posting.

The embodiments of the invention in which an exclusive property right or privilege is claimed are defined as follows:

1. An automatic document merging system for merging and attaching images of remittance documents to their respective envelopes comprising:

a) first hopper means for receiving and holding a plurality of paper sheets containing images of remittance documents;

b) second hopper means for receiving and holding a plurality of envelopes;

c) means for cutting said paper sheets into strips of predetermined dimensions;

d) a first conveyor means for receiving said strips from said cutting means and for advancing and directing said strips along an advancement channel;

e) a second conveyor means for receiving said envelopes and for advancing and directing said envelopes along an advancement channel, said advancement of said envelopes being timed so as to synchronize with the advancement of said strips from said first conveyor means;

f) a third conveyor means for receiving the strips and envelopes from said first and second conveyor means, for merging said strips and envelopes together at a pinch point, and for further advancement of the merged documents along an advancement channel;

g) means for applying adhesive for securing said strips to said envelopes;

h) third hopper means for receiving and holding said strips and envelopes after they have been attached and united by the action of said third conveyor means; and, i) means for controlling and synchronizing the advancement, merger and attachment of said strips and envelopes.

2. The apparatus of claim 1, wherein said first hopper means further comprises a bin having a plurality of feeder belts situated along the bottom of said bin for advancing said sheets to said cutting means.

3. The apparatus of claim 1, wherein said second hopper means further comprises a bin for holding said envelopes in a vertical position and having an urging means for advancing and transporting said envelopes from said second hopper means to said securing means.

4. The apparatus of claim 1, wherein said cutting means further comprises one or more advancement rollers for automatically advancing said strips from said cutting means to said first conveyor means.

5. The apparatus of claim 1, wherein said first conveyor means comprises a plurality of conveyor belts for receiving said strips from said cutting means, for rotating said strips from a horizontal to a vertical position and for advancing said strips along said advancement channel toward said pinch point of said third conveyor means for further processing.

6. The apparatus of claim 1, wherein said second conveyor means comprises a plurality of advancement rollers situated along said advancement channel for automatically advancing said envelopes, in a vertical position, toward said pinch point of said third conveyor means for further processing.

7. The apparatus of claim 1, wherein said securing means comprises an applicator means for applying an adhesive to said envelopes received from said second hopper means and having a plurality of advancement rollers for automatic lateral advancement of said envelopes from said securing means to said second conveyor means.

8. The apparatus of claim 1, wherein said third conveyor means further comprises a merger channel and an advancement channel, said channels having plurality of advancement rollers situated thereon, said merger channel being divided into a pair of channels which converge at said pinch point and are designed to receive, merge and unite the strips and envelopes being synchronously advanced from said first and second conveyor means.

9. The apparatus of claim 1, wherein said third hopper means comprises a bin for receiving and holding the merged documents received from said third conveyor means and further comprising a gate means for automatically sensing the arrival of said merged documents and for applying tension to said merged documents after entry into said bin.

10. The apparatus of claim 1, wherein said means for controlling and synchronizing the advancement, merger and attachment of said strips to said envelopes comprises an advancement control device for controlling the advancement speed and positioning of said strips and envelopes as they advance through said system and a brake/advance pedal for starting and stopping the operation of the system.

11. The apparatus of claim 1, wherein said securing means comprises an automatic attachment device positioned along said third conveyor means at or near said pinch point, for securely uniting said strips and envelopes together as they pass through said pinch point of said third conveyor means.

12. The apparatus of claim 6, wherein said advancement rollers and said advancement channel of said second conveyor means are adjustable to allow for varying thicknesses of said envelopes.

13. The apparatus of claim 8, wherein said merge rollers and said advancement channel of said third conveyor means are adjustable to allow for varying thicknesses of said merged strips and envelopes.

14. The apparatus of claim 1, wherein said system further comprises a copying device for generating the paper sheets containing images of said remittance documents.

15. The apparatus of claim 1, wherein said means for controlling and synchronizing the advancement, merger and attachment of said strips and envelopes further comprises sensing devices, encoding devices and counting devices for sensing, encoding and counting said strips and envelopes as they advance through said system.

16. The apparatus of claim 1, wherein said means for controlling and synchronizing the advancement, merger and attachment of said strips and envelopes is computer assisted.

17. An automatic document merging system for merging and attaching images of remittance documents to their respective envelopes comprising:

a first hopper means comprising a bin for receiving and holding a plurality of paper sheets containing images of remittance documents and having a plurality of feeder belts situated along the bottom of said bin for advancing or transporting said sheets to a cutter means;

a cutter means for receiving said sheets and for cutting said sheets, if necessary, into strips of predetermined dimensions, said cutter means further comprising one or more advancement rollers for advancing said strips onto a first conveyor means for further processing;

a second hopper means comprising a bin for receiving and vertically holding a plurality of remittance envelopes and having an urging means for advancing and transporting said envelopes toward and into a securing means for further processing;

a securing means for receiving said envelopes from said second hopper means and for applying an adhesive strip along the advancing side of each remittance envelope, said securing means having an applicator device for applying said adhesive and further having a plurality of advancement rollers for laterally advancing each envelope toward a second conveyor means as the applicator device is applying adhesive to said envelope;

a first conveyor means comprising a plurality of conveyor belts for receiving and advancing said strips from said cutter means toward a pinch point, positioned along a third conveyor means, said belts also rotate each strip from a horizontal position to a vertical position as said strip is caused to travel along said first conveyor means;

a second conveyor means comprising a plurality of advancement rollers situated along an advancement channel for advancing said remittance envelopes from said securing means, simultaneously and synchronously with the advancement of said strips along said first conveyor means, toward said pinch point of said third conveyor means for eventual merger with said strips;

a third conveyor means comprising a merger channel and an advancement channel, said channels having a plurality of advancement rollers operably situated thereon, said merger channel being divided into a pair of channels which converge at said pinch point and are designed to receive, merge and unite the strips and envelopes being synchronously advanced from said first and second conveyor means, said merged and united strips and envelopes being further advanced by said advancement channel rollers along said advancement channel to a third hopper means;

a third hopper means comprising a bin for receiving and holding the merged strips and envelopes received from said third conveyor means and further comprising a gate means for automatically sensing the arrival of said merged documents and for applying tension against said merged documents after entry into said bin for proper stacking; and, a control means comprising an advancement control device for controlling the speed and positioning of said strips and envelopes as they advance through said system and a brake/advance pedal for starting and stopping the operation of the system.

18. The apparatus of claim 17, wherein said securing means comprises an automatic attachment device positioned along said third conveyor means at or near said pinch point, for securely uniting said strips and envelopes together as they pass through said pinch point of said third conveyor means.

19. The apparatus of claim 17, wherein said advancement rollers and said advancement channel of said second conveyor means are adjustable to allow for varying thicknesses of said envelopes.

20. The apparatus of claim 17, wherein said advancement rollers and said merger channel of said third conveyor means are adjustable to accommodate and allow for varying thicknesses of said merged strips and envelopes.

21. The apparatus of claim 17, wherein said system further comprises a copying device for generating the paper sheets containing the images of said remittance documents.

22. The apparatus of claim 17, wherein said control means further comprises sensing devices, encoding devices and counting devices for sensing, encoding and counting said strips and envelopes as they advance through the system.

23. The apparatus of claim 17, wherein said control means is computer assisted.

* * * * *